US007852986B2

(12) United States Patent
Loef et al.

(10) Patent No.: US 7,852,986 B2
(45) Date of Patent: Dec. 14, 2010

(54) POWER SUPPLY FOR AN X-RAY GENERATOR SYSTEM

(75) Inventors: Christoph Loef, Aachen (DE); Gereon Vogtmeier, Aachen (DE); Günter Zeitler, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 6 days.

(21) Appl. No.: 12/438,563

(22) PCT Filed: Aug. 21, 2007

(86) PCT No.: PCT/IB2007/053331

§ 371 (c)(1),
(2), (4) Date: Feb. 24, 2009

(87) PCT Pub. No.: WO2008/026127

PCT Pub. Date: Mar. 6, 2008

(65) Prior Publication Data

US 2009/0290683 A1 Nov. 26, 2009

(30) Foreign Application Priority Data

Aug. 31, 2006 (EP) ..... 06119924

(51) Int. Cl.
*H05G 1/32* (2006.01)

(52) U.S. Cl. ..... 378/111; 378/101

(58) Field of Classification Search ..... 378/110–111, 378/101, 114, 104

See application file for complete search history.

(56) References Cited

U.S. PATENT DOCUMENTS 3,333,104 A 7/1967 Bougle
4,333,011 A 6/1982 Mester
5,602,897 A 2/1997 Kociecki et al.
5,914,999 A * 6/1999 Beyerlein et al. ..... 378/105
5,923,721 A 7/1999 Duschka
2005/0018815 A1 * 1/2005 Loef et al. ..... 378/101

FOREIGN PATENT DOCUMENTS

GB 669395 4/1952
WO 03049270 A2 6/2003

OTHER PUBLICATIONS

Esteve, F., et al.; Coronary Angiography with Synchrotron X-ray Source on Pigs after Iodine or Gadolinium Intravenous Injection; 2002; Acad Radiol.; 9:S92-S97.

Riederer, S. J., et al.; Selective iodine imaging using k-edge energies in computerized x-ray tomography; 1977; Medical Physics; 4(6)474-481.

Rubenstein, E., et al.; Transvenous coronary angiography in humans using synchrontron radiation; 1986; Proc. Natl. Acad. Sci. USA; 83;9724-9728.

* cited by examiner

*Primary Examiner*—Hoon Song

(57) ABSTRACT

A power supply for generating a high output voltage for supplying an X-ray generator system with at least one X-ray source (17), especially for computer tomography (CT) applications is disclosed, wherein the high output voltage comprises at least two different high output voltage levels ($U_1$; $U_1 \pm U_2$) which are fast switchable so that spectral CT measurements can be conducted with one conventional X-ray tube (17). Furthermore, an X-ray tube generator system comprising such a power supply and at least one X-ray tube (17), as well as a computer tomography (CT) apparatus comprising such a power supply is disclosed.

12 Claims, 10 Drawing Sheets

POWER SUPPLY FOR AN X-RAY GENERATOR SYSTEM

FIELD OF THE INVENTION

The invention relates to a power supply for generating a high output voltage for supplying an X-ray generator system with at least one X-ray source (like an X-ray tube), especially for computer tomography (CT) applications, wherein the high output voltage comprises at least two different high output voltage levels. Furthermore, the invention relates to an X-ray tube generator system comprising such a power supply and at least one X-ray tube, and to a computer tomography (CT) apparatus comprising such a power supply.

BACKGROUND OF THE INVENTION

The development of computer tomography goes on the one hand towards systems with multi X-ray tubes and multi-slice cone beam detectors especially in order to obtain three-dimensional projection data sets of a patient which are suitable for a three-dimensional reconstruction of the scanned volume.

On the other hand, computer tomography is further developed for new applications and especially improved imaging qualities, wherein especially the energy information of the X-ray beam ("spectral CT") is used as additional physical information to improve such image quality and contrast resolution and also to enable new diagnostic benefits like material identification and quantification from the clinical images.

Both these applications and developments require power supplies which generate two or more, preferably different high output voltages for at least one X-ray tube. Furthermore, it is desired especially for spectral CT imaging to switch between at least two different X-ray tube voltages (or voltage levels) very fast, because otherwise severe motion artifacts are to be observed.

A particular problem with known such high voltage generators for two independent high voltages is that they require much space and are comparatively heavy so that they are not well suited for use in a rotating gantry of a computer tomography apparatus.

Another problem is that a high voltage which is generated with a voltage multiplier usually cannot be changed or varied within a sufficiently short time which is necessary for obtaining spectral X-ray images of sufficient quality. This applies as well for a multi-phase high voltage multiplier as disclosed in WO 2003/049270 A2.

SUMMARY OF THE INVENTION

In view of the above, it would be advantageous to achieve a power-supply for generating a high output voltage which comprises at least two different high output voltage levels and which power supply has a comparatively small volume and a low weight so that it can especially be used in the gantry of a computer tomography apparatus.

According to claim 1 a power supply is presented which comprises at least a first voltage source for providing a first voltage level $U_1$ and a second voltage source for providing a second voltage level $U_2$, which voltage sources are connected in a cascade in order to generate the high output voltage which comprises at least a first high output voltage level which is at least substantially equal to the first voltage level $U_1$, and a second high output voltage level which is at least substantially equal to the cascaded first and second voltage levels $U_1 \pm U_2$.

By the terms "at least substantially", e.g. possible losses in lines or other components are considered which might lead to a high output voltage level which is not exactly equal to the first voltage level $U_1$ and/or the cascaded first and second voltage levels $U_1 \pm U_2$.

By a cascading of such at least two voltage sources, on the one hand, at least two different high output voltage levels can be branched off, and on the other hand, heavy and bulky parts like frequency inverters, high voltage transformers and/or high voltage multipliers need only be used in one exemplar each, so that weight and volume is saved.

By this power supply, e.g. a first X-ray tube can be supplied with the first high output voltage level and a second X-ray tube can be supplied with the second high output voltage level, so that both X-ray tubes generate accordingly different X-ray spectra.

Another advantage of this power supply is that most conventional X-ray tubes can be supplied in order to conduct different energy level measurements e.g. for spectral CT imaging or K-edge imaging.

The subclaims disclose advantageous embodiments of the invention.

The embodiment according to claim 2 has the advantage that due to a second lower voltage level both high output voltage levels and by this both X-ray spectra (generated by the connected X-ray tubes) differ and especially have a corresponding small difference from each other which is usually desired for most examinations. Furthermore, depending on the selected circuit layout, such a lower voltage level can usually be switched faster, i.e. with shorter rise and fall times than a high voltage level.

The embodiment according to claim 3 has the advantage that one X-ray tube can be used for conducting different energy level measurements because by using a switch the high output voltage can be changed in most cases sufficiently fast between the at least two different high output voltage levels. Furthermore, in case of operating two X-ray tubes (especially when switching to the same high output voltage) the acquisition speed can be doubled and the power limitation of the X-ray tube can be relaxed.

The embodiment according to claim 4 has the advantage of an especially low weight and volume because only one frequency inverter, one resonance circuit and one high voltage transformer have to used.

The embodiment according to claim 5 has the advantage that the high output voltage can be changed in a comparatively easy manner between more than two different high output voltage levels, and, especially if the second high voltage levels are not too high, they can be changed also sufficiently fast for most of the above mentioned applications.

The embodiment according to claim 6 has the advantage that a (user-) selected high output voltage level can be obtained in an exact and reliable manner.

The embodiment according to claim 7 has the advantage that an optimized switching timing of the connected X-ray tubes can be provided.

The embodiments according to claims 8 to 11 disclose a preferred first high voltage source and several preferred second (lower) voltage sources, respectively, which are advantageously selected depending on the proposed application of the power supply.

Further details, features and advantages of the invention become apparent from the following description of exemplary and preferred embodiments of the invention in connection with the drawings.

DETAILED DESCRIPTION OF PREFERRED EMBODIMENTS

Figure 1:
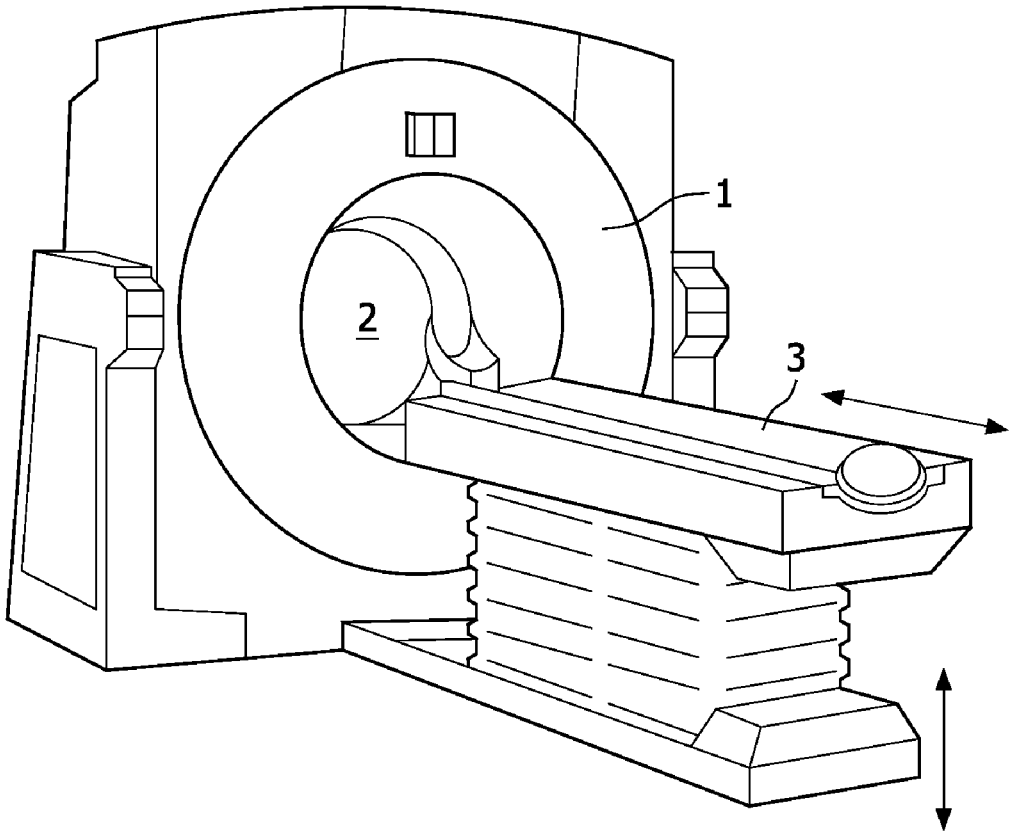
FIG. 1 shows a schematic view of a computer tomography apparatus.

FIG. 1 schematically shows a computer tomography apparatus comprising a gantry 1 with an opening or a bore 2 into and through which a patient lying on a table 3 is shifted. An X-ray generator system comprising at least one X-ray source, especially a X-ray tube, and at least one corresponding X-ray detector are mounted at the gantry 1 in opposing positions. During translation of the patient table 3 through the bore 2 of the gantry 1, the gantry 1 rotates, so that the focus of the X-ray source describes a helix around the patient and progresses along with the axis of the patient with each rotation (helical scan). By this, the patient is scanned in a known manner. The received image data are processed by means of a computer aided processing means in a known manner to a tomography image which is displayed on a monitor.

The gantry 1 is usually rotated with several rounds per second around the patient, so that a low weight of the gantry and its components is of substantial importance.

Especially the transformers of the power supply for generating the at least one high output voltage for supplying the X-ray generator system contribute a considerable portion of the whole weight of the power supply, which is usually mounted together with the X-ray generator system at the gantry 1 of a CT apparatus.

In the following, a first and a second embodiment of the invention shall be described in the form of a power supply for generating two different high output voltage levels especially for two X-ray sources and especially for a fast cone beam dual X-ray tube CT system, wherein the power supply has a low weight and low space requirements so that it can especially be used in a gantry for operating two X-ray sources at different (or optionally at the same) X-ray tube voltages.

Figure 2:
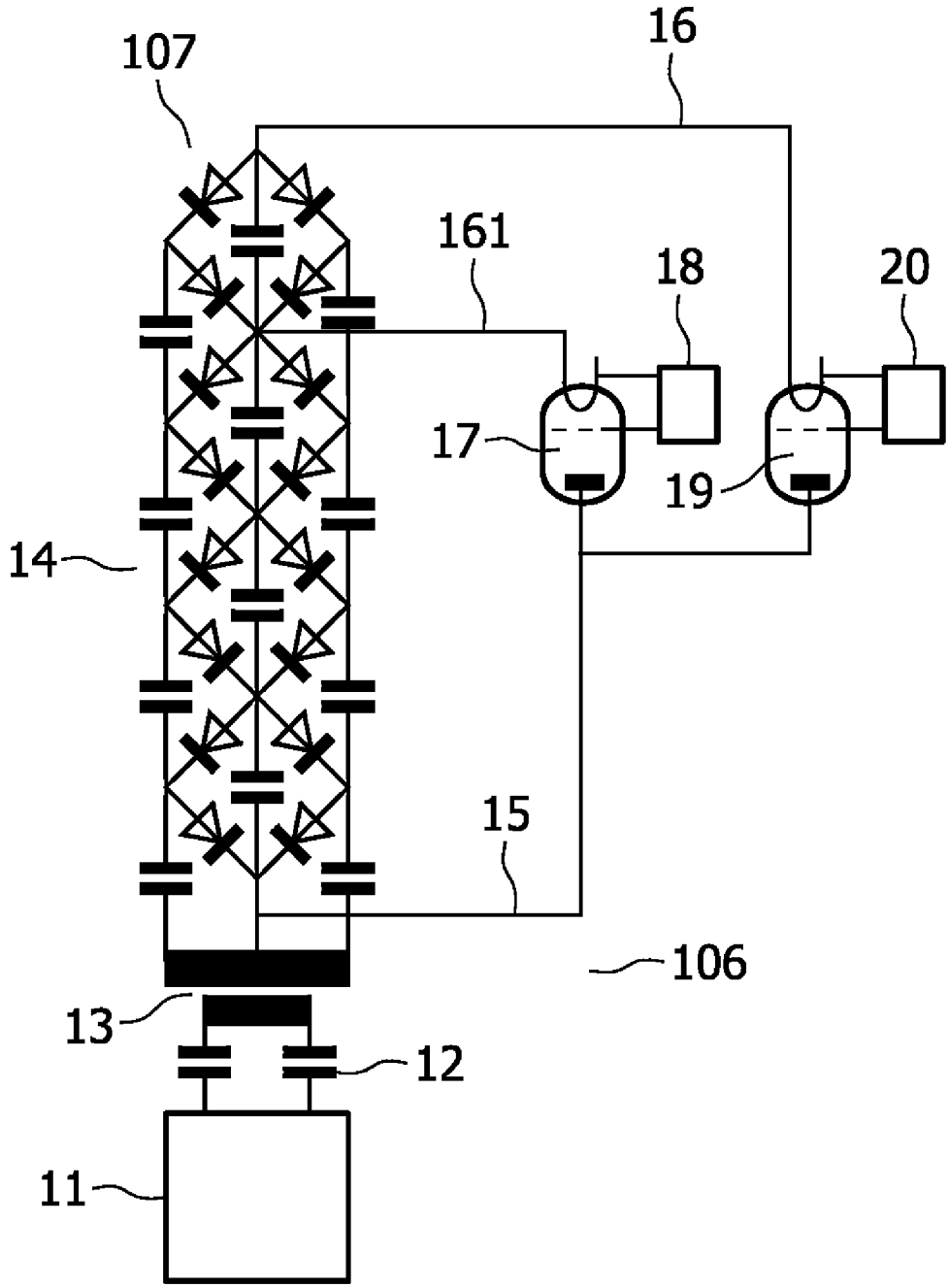
FIG. 2 shows a first embodiment of a power supply according to the invention.

The first embodiment of such a dual high output voltage power supply is shown in FIG. 2. It comprises a high frequency inverter 11, a resonance circuit 12 which is connected with the output of the high frequency inverter 11, and a high voltage transformer 13 which is connected with its primary side with the resonance circuit 12. The secondary side of the high voltage transformer 13 is connected with the input terminals of a four stage voltage multiplier 14 having a first output terminal 161 after three stages, so that a first high voltage source 106 is provided for generating a first high voltage level.

A second voltage source 107 for providing a second lower voltage level is provided by a following fourth stage of the voltage multiplier 14 and a second output terminal 16.

Depending on the turn ratio of the transformer 13, other numbers of voltage multiplier stages are possible in both voltage sources 106, 107. Furthermore, the number of stages of the second voltage source 107 can be different from 1 as well, depending especially on the application demands.

The first and second (negative) output terminals 161, 16 are connected with the cathodes of a first and a second X-ray source in the form of a first X-ray tube 17 and a second X-ray tube 19, respectively. A third (positive) output terminal 15 of the power supply is connected with the center tap of the high voltage transformer 13 and fed to the anodes of both X-ray tubes 17, 19. Due to the cascading of the first and the second voltage source, the first high output voltage level at the first X-ray tube 17 is less than the second high output voltage level at the second X-ray tube 19 so that the generated X-ray spectra differ from each other accordingly.

Preferably, the first X-ray tube 17 is controlled by means of a first grid switch unit 18, and the second X-ray tube 19 is controlled by means of a second grid switch unit 20 as generally known.

The X-ray tubes 17, 19 are preferably switched in an interleaved mode, because a parallel operation of both tubes 17, 19 could cause scatter image artifacts. Optionally, a certain dead time is applied when changing from one to the other X-ray tube in order to avoid crosstalk effects between the tubes 17, 19.

Figure 3:
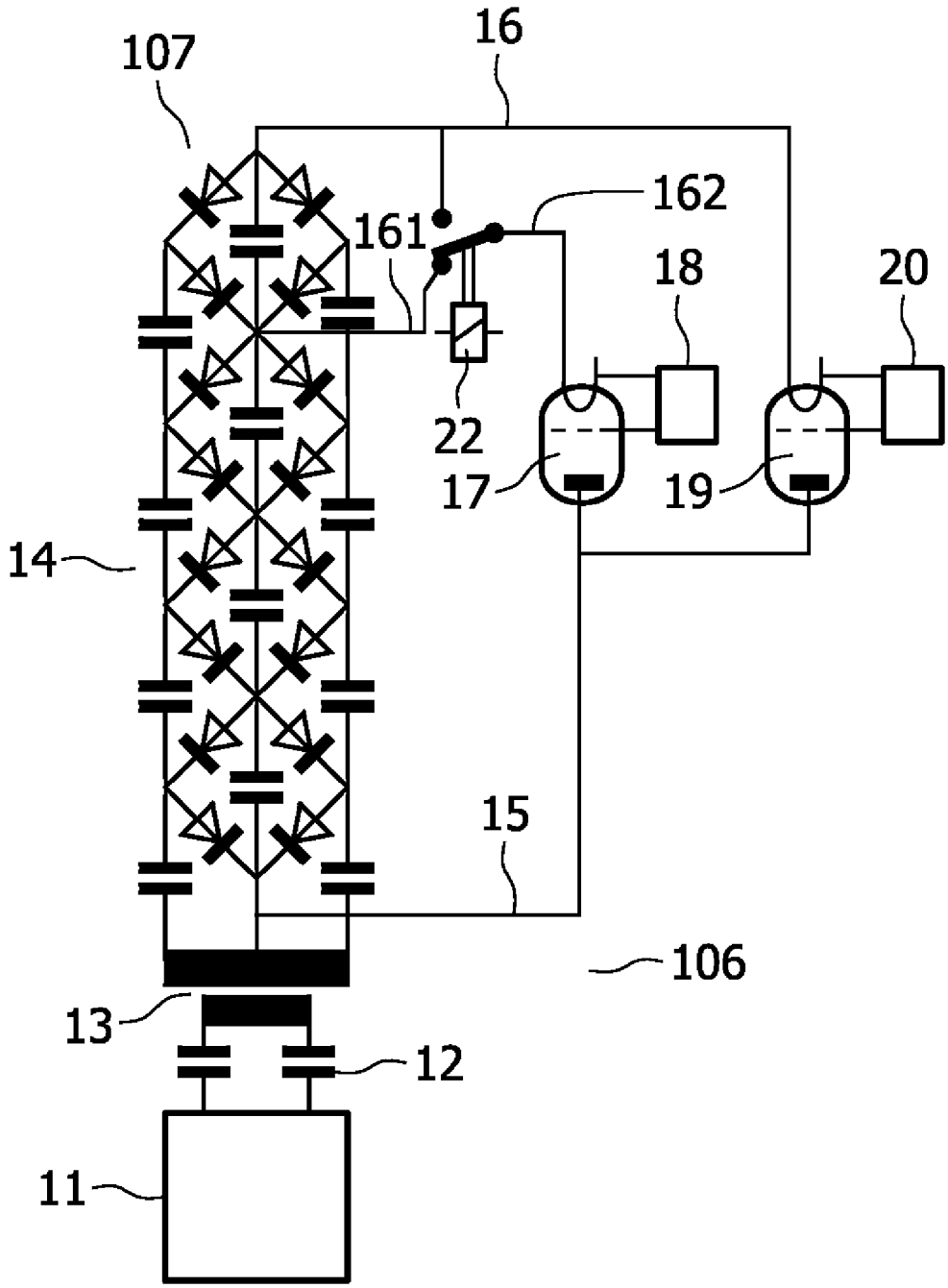
FIG. 3 shows a second embodiment of a power supply according to the invention.

FIG. 3 shows the second embodiment of a dual high output voltage power supply for two X-ray sources 17, 19. The same or corresponding parts or components are denoted with the same reference numerals as in FIG. 2 so that in the following only the differences to the first embodiment shall be explained.

The basic difference is that the second embodiment comprises a switchable output terminal 162 which by means of a switch 22 can be switched between the output terminal 161 of the first voltage source 106 and the output terminal 16 of the second voltage source 107.

This second embodiment can be used for dual and non-dual energy applications by operating the switch 22 so that the cathode terminal of the first X-ray source 17 is either connected with the first or with the second output terminal 16, 161. This second embodiment enables an operation of both X-ray sources 17, 19 with the same second high output voltage level and correspondingly a scanning of the volume examined with the same X-ray spectrum or, according to the first embodiment, with different X-ray spectra. In order to change between both, the switch 22 is preferably an electromechanically controlled relay which can be operated by a user and/or automatically by means of a control system according to a predetermined or selected scan protocol.

By means of this second embodiment, e.g. two scanning operations can be conducted by means of a CT apparatus in an easy manner either with identical or different X-ray spectra.

If both X-ray tubes 17, 19 are operated at the same high output voltage, for example three-dimensional projection data sets of a patient can be obtained for reconstruction of a three-dimensional image of the entire scanned volume with the same X-ray spectrum. In this case, the two X-ray tubes 17, 19 are positioned at the gantry preferably with a radial shift of for example 90 degree (with two independent X-ray detectors each in opposite position to each X-ray tube), so that the two separate scans of the volume of the patient are delayed only within a quarter of the gantry rotation speed and both scans are conducted within a sufficiently short period of time.

A procedure to obtain such a three-dimensional projection data set is the so called helical scan as explained above, using two X-ray sources and two X-ray detectors.

Another advantage of such a dual X-ray tube CT system is that the acquisition speed for generating images can be doubled. Furthermore, either the power limitation of each X-ray tube is relaxed with such a system. or a higher total peak X-ray power density can be obtained at the scanned volume from both X-ray tubes 17, 19.

By an increased image acquisition speed, more physical information about the scanned volume and especially an improved image quality can be obtained with these embodiments like for example a better contrast, a higher time resolution (in order to obtain images from moving objects like the heart) or a higher spatial resolution (for example for imaging small details of blood vessels).

Furthermore, an improved image quality can also be obtained by switching the switch 22 such that different high output voltage levels are applied to the X-ray tubes 17; 19 as indicated in FIG. 2, especially in order to conduct two different energy level measurements independent from each other. Accordingly, two different X-ray spectra are generated and different energy information is obtained from the scanned volume as mentioned above with respect to FIG. 2. Due to its compact size and low weight, the power supply according to the first and second embodiment is especially suitable for such an application in a gantry of a dual X-ray tube and dual high voltage spectral CT apparatus or system for high temporal and/or spatial resolution.

A third to fifth embodiment of the invention shall now be described in the form of power supplies for fast multi high voltage settings (switchings), especially for one X-ray tube in a spectral CT apparatus or system for conducting energy level measurements in order to gain and evaluate multi energy information from the scanned volume (however, fast dual high voltage settings can be realized with these embodiments as well, and more than one X-ray tube could be operated as well, e.g. similarly as indicated in FIGS. 2 and 3).

It shall be mentioned here that generally such a spectral CT apparatus can be based either on an X-ray source with different radiation spectra or on energy resolving X-ray detectors.

Regarding X-ray detector related CT concepts for energy resolution, use can be made of an integrating detector with at least two or multi-layer scintillator arrangements. Another possibility is to use combined counting and integrating with a dedicated detector simultaneously and also with different energy thresholds. A third alternative is to use counting detectors with energy resolution in each pixel by using energy windowing (bins) or energy weighting techniques.

Regarding X-ray source related spectral CT concepts for energy resolution, use can be made of two or more monoenergetic X-ray sources like for example synchrotron radiation, or different sets of monochromators or pre-patient filters. However, according to the third to fifth embodiment of the invention, use is made of one conventional X-ray tube operated by a power supply according to the description alternating at very fast switchable, at least two different high output voltage levels for generating accordingly at least two different X-ray energy spectra.

Consequently, a basic idea of the third to fifth embodiment of the invention is to use one conventional X-ray source and a new X-ray generator concept operating at least at two different but very fast switchable high output voltages for generating different (but well known) polychromatic emission spectra within one image frame.

The data are acquired with a conventional CT detector with a sub-frame data acquisition method synchronously to the settings of the high output voltage of the power supply for the X-ray tube (X-ray generator). A processing of these data according to spectral CT models (e.g. Alvarez, Macovski: Energy-selective reconstructions in X-ray Computerized Tomography, Phys. Med. Biol. 197, or Riederer, Mistretta: Selective iodine imaging using K-edge energies in computerized X-ray tomography, Med. Phys. Vol. 4, No. 6, 1977) allows generating different clinical images including a quantitative contrast agent (e.g. iodine or gadolinium) only image. This opens up a new field of CT imaging with the benefits discussed above. Some more detailed explanation of spectral CT with multi high output voltage level (multi-kV) switching will be given at the end of this description.

Figure 4:
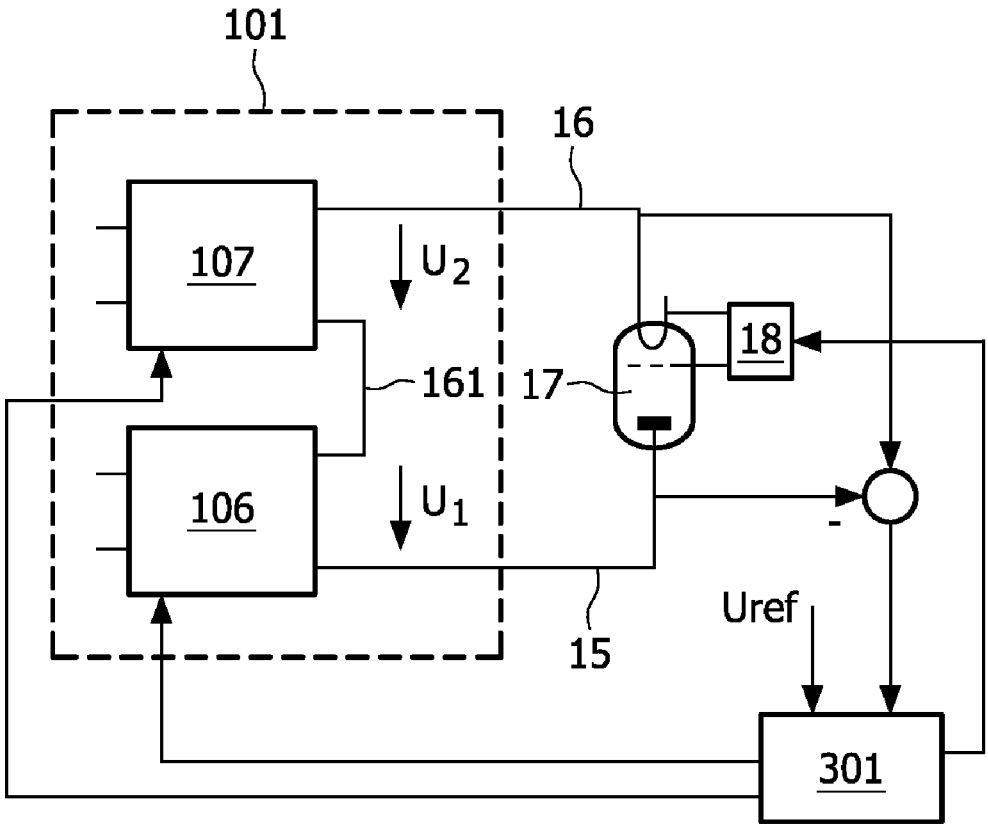
FIG. 4 shows a first basic outline of a power supply of a third to fifth embodiment of the invention.

FIG. 4 shows a first basic outline of a power supply according to the third to fifth embodiment for one X-ray tube 17.

The power supply comprises a high voltage generator 101 and a controller circuit 301. The high voltage generator 101 comprises a first voltage source 106 for generating a first (positive or negative) voltage level $U_1$, and a second voltage source 107 for generating a second (positive or negative) voltage level $U_2$. Both voltage levels are cascaded via a connection 161 to a high output voltage level $U_1 \pm U_2$ and connected with output terminals 15, 16 of the high voltage generator 101. These output terminals 15, 16 are connected with the anode and the cathode, respectively, of the X-ray tube 17.

Preferably, at least one of the first and the second voltage source 106, 107 provides a galvanic isolation.

The high output voltage level $U_1 \pm U_2$ is measured and compared with a reference voltage level $U_{ref}$ by means of the controller circuit 301. The controller circuit 301 is provided for supplying at least one of a first and a second control signal for controlling at least one of the first and the second voltage source 106, 107, respectively, in order to set the desired cascaded high output voltage level $U_1 \pm U_2$. By connecting the two regulated voltage sources 106, 107 according to FIG. 4 in cascade, a high output voltage is provided which can be switched between two or more high output voltage levels very fast.

More in detail, one of the voltage sources 106 (107) is a high voltage source which generates a high voltage level, which is e.g. approximately equal to the lowest or highest output voltage level, e.g. the lower voltage level for the K-edge energy of a contrast medium in an object to be imaged. This high voltage source 106 (107) could be realised by means of e.g. a high voltage multiplier.

The other voltage source 107 (106) is a low voltage source which generates a low voltage level in comparison to the high voltage level, which low voltage level can be positive or negative and which is equal to the difference between the required high output voltage level $U_1 \pm U_2$ of the high voltage generator 101 and the high voltage level of the high voltage source 106 (107).

Furthermore, the low voltage source 107 (106) is provided such that upon switching it between a first and a second voltage level, the new voltage level is generated with a steep flank (i.e. a short rising and falling time). Since the low voltage source only has to generate voltage levels between about zero and e.g. about 30 kV, only a low amount of energy storage is required in the low voltage source and thus a faster voltage rise is realizable.

The voltage fall depends on the present X-ray tube current. In this case a unidirectional voltage source can be used. If the X-ray tube 17 is connected via a long high voltage cable to the voltage generator 101, the cable gives additional energy storage. To ensure a fast voltage fall in this arrangement as well, the low voltage source should be a bidirectional voltage source. During a voltage fall, the energy stored in the cable is transferred in this case back to the intermediate stage of the inverter input terminals of the high voltage generator 101.

Optionally, the X-ray tube 17 can be operated with a gating tube grid which is controlled by means of a grid switch unit 18. In this case, it is preferred that the controller circuit 301 is provided for supplying a third control signal for controlling the grid switch unit 18 so that it operates in a synchronized mode and thus providing an optimized switching timing of the X-ray tube 17.

Figure 5:
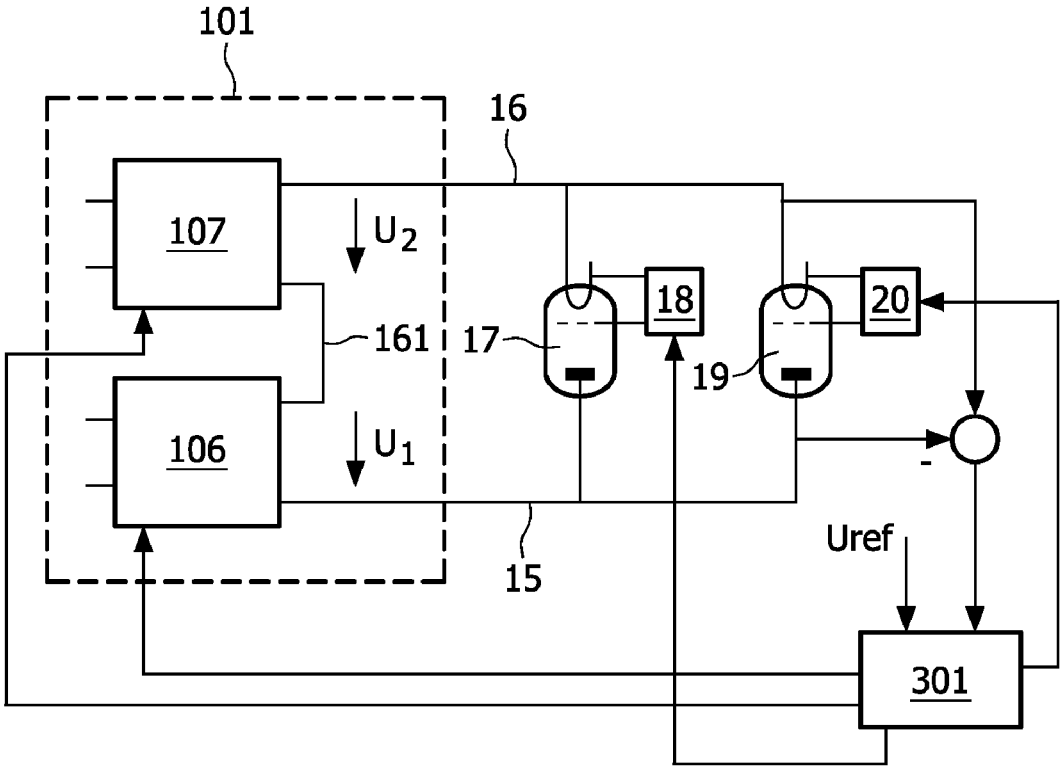
FIG. 5 shows a second basic outline of a power supply of the third to fifth embodiment of the invention.

FIG. 5 shows a second basic outline of a power supply according to the third to fifth embodiment for two X-ray tubes, wherein the same or corresponding components as in FIG. 4 are denoted with the same reference numerals.

The power supply again comprises a high voltage generator 101 and a controller circuit 301 and is especially provided for double focus operation by means of two X-ray tubes 17, 19 which are connected in parallel with the output terminals 15, 16 of the high voltage generator 101. The high voltage generator 101 again comprises a first and a second voltage source 106, 107, preferably for generating a high voltage level and a fast switchable low voltage level as explained above with reference to FIG. 4, wherein the first and/or the second voltage source 106, 107 is again controlled by means of the controller circuit 301 by supplying a first and/or a second control signal, respectively.

Furthermore, both the X-ray tubes 17, 19 are optionally gated with a gating tube grid which is controlled by each a grid switch unit 18, 20, respectively. Preferably, at least one of these grid switch units 18, 20 is controlled by means of a third and/or a fourth control signal, respectively, which is supplied by the controller circuit 301 so that the X-ray tubes 17, 19 operate in a synchronized mode, thus providing an optimized switching timing of the X-ray tubes 17, 18. The X-ray tubes 17, 19 are preferably operated in an alternating mode.

Figure 6:
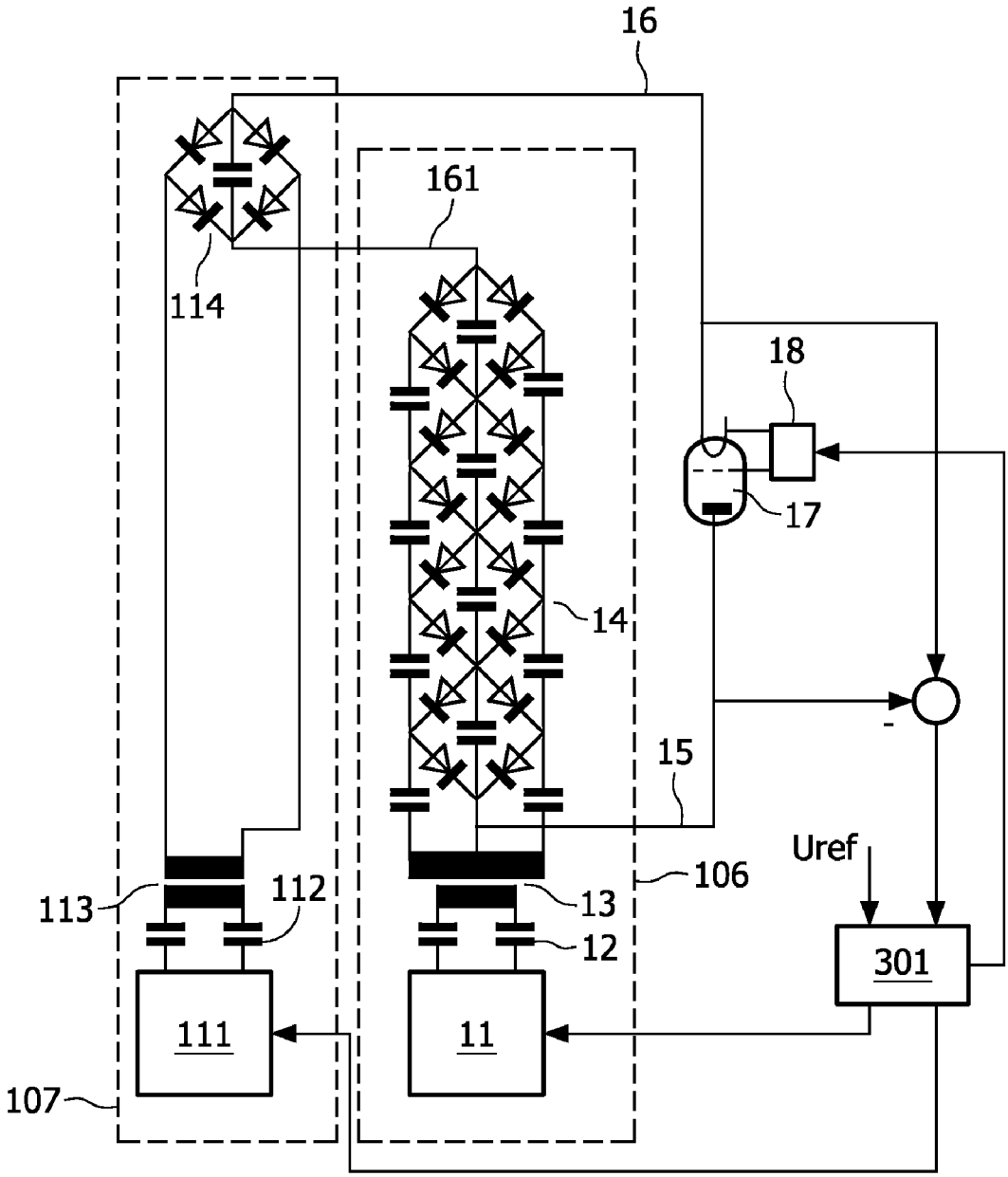
FIG. 6 shows the third embodiment of a power supply according to the invention.

In FIG. 6 an exemplary power supply according to the third embodiment of the invention is shown. It comprises the first high voltage source 106 for generating a first preferably constant high voltage level $U_1$ and the second controllable low voltage source 107 for generating a second lower but fast switchable voltage level $U_2$. Both voltage levels are cascaded via a connection 161 to a high output voltage level $U_1 \pm U_2$ at terminals 15, 16 as explained with reference to FIG. 4.

More in details, the first high voltage source 106 comprises a first high frequency inverter 11, the output terminals of which are connected with a first resonance circuit 12. Furthermore, a first high voltage transformer 13 is provided which is connected with its primary side with the first resonance circuit 12. The secondary side of the first high voltage transformer 13 is connected with a high voltage multiplier 14. The output of the voltage multiplier 14 provides the first high voltage level $U_1$ at a connection 161.

The second low voltage level $U_2$ is generated by means of the second low voltage source 107 which comprises a second high frequency inverter 111, the output terminals of which are connected with a second resonance circuit 112. A second high voltage transformer 113 is connected with its primary side with the second resonance circuit 112. The secondary side of the second high voltage transformer 113 is connected with a high voltage rectifier 114. The output of the voltage rectifier 114 provides the second low voltage level $U_2$ which is cascaded via the connection 161 with the first high voltage level $U_1$ and supplied via output terminals 15, 16 to the X-ray tube 17.

In this circuit arrangement the first high voltage source 106 provides the first preferably constant high voltage level $U_1$ whereas the second low voltage source 107 provides the second lower voltage level $U_2$, which is controllable so that it is substantially equal to the difference between the desired high output voltage level at the terminals 15, 16 of the X-ray tube 17 and the first constant high voltage level $U_1$ as explained above.

The X-ray tube 17 can again be gated by means of a grid, which is controlled with a dedicated grid switch unit 18. The high output voltage is measured and compared with a reference voltage level $U_{ref}$ by means of a controller circuit 301. The controller-circuit 301 is provided for controlling especially the second high frequency inverter 111 (and optionally the first high frequency inverter 11 as well) in order to set the desired high output voltage at terminals 15, 16.

Figure 7:
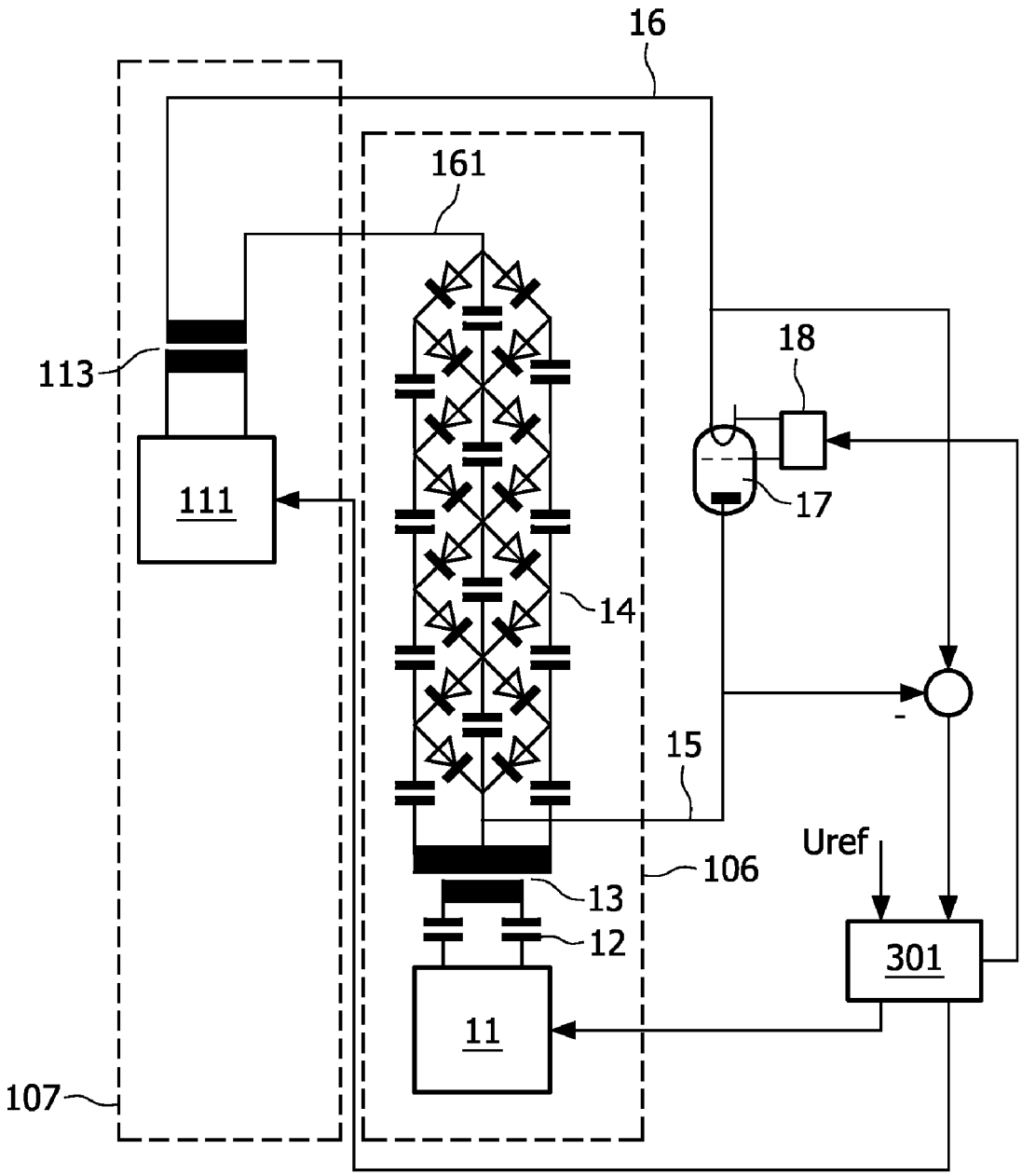
FIG. 7 shows the fourth embodiment of a power supply according to the invention.

A fourth embodiment of a power supply according to the invention is shown in FIG. 7, wherein the same or corresponding components as in FIG. 6 are denoted with the same reference numerals.

The power supply again comprises a first high voltage source 106 for generating a first preferably constant high voltage level $U_1$ and a second controllable low voltage source 107 for generating a second lower but fast switchable voltage level $U_2$. Both voltage levels are cascaded via a connection 161 according to FIGS. 4 and 6 to a high output voltage level $U_1 \pm U_2$.

The first high voltage source 106 comprises a first high frequency inverter 11, a resonance circuit 12 and a first high voltage transformer 13, which supplies a high voltage multiplier 14 according to the third embodiment shown in FIG. 6 for generating the first high voltage level $U_1$ at the connection 161 which again is substantially constant.

The second low voltage source 107 comprises a second high frequency inverter 111 which is connected with the primary side of a second high voltage transformer 113. At the secondary side, the second low voltage level $U_2$ is provided which again is controllable as explained above.

As both voltage sources 106, 107 are cascaded, the X-ray tube 17 is supplied via output terminals 15, 16 with a high output voltage which is the sum of the first and the second voltage levels $U_1 \pm U_2$. The high output voltage level is again measured and compared with a reference voltage level $U_{ref}$ by means of a controller circuit 301. The controller circuit 301 is provided for controlling the second high frequency inverter 111 (and optionally the first high frequency inverter 11 as well) in order to set the desired high output voltage.

With these embodiments, the first high voltage source 106 generates a first high voltage level, which is e.g. identical to the K-edge voltage of a contrast medium in an object to be scanned. The second lower voltage level at the secondary winding of the second transformer 113 is either zero, negative or positive, depending on the primary voltage generated by the second high frequency inverter 111. However, with respect to the voltage-second product of the second transformer 113, the second lower voltage level at the transformer output must be zero for a given time. Thus, the positive and negative voltage-second product of the transformer secondary winding voltage must be equal.

Figure 8:
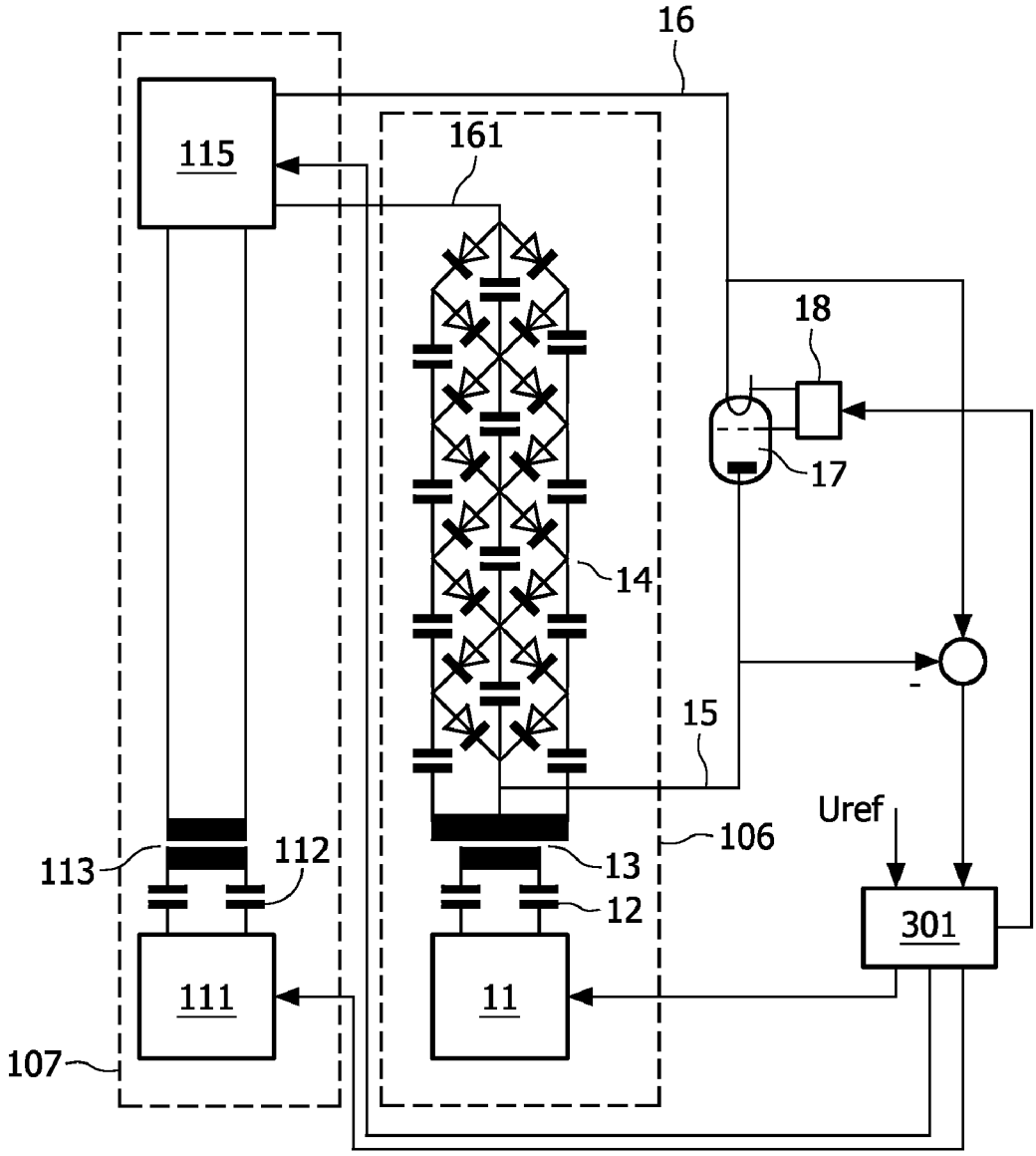
FIG. 8 shows the fifth embodiment of a power supply according to the invention.

A fifth embodiment of a power supply according to the invention is shown in FIG. 8, wherein the same or corresponding components as in FIGS. 6 and 7 are denoted with the same reference numerals.

The power supply again comprises the first high voltage source 106 for generating a first preferably constant high voltage level and the second controllable low voltage source 107 for generating a second lower but fast switchable voltage level. Both voltage levels are cascaded via a connection 161.

The first high voltage source 106 comprises a first high frequency inverter 11, a first resonance circuit 12 which is connected with the first frequency inverter 11 and a first high voltage transformer 13, which is connected with its primary side with the first resonance circuit 12 and which supplies a high voltage multiplier 14 at its secondary side as shown in FIGS. 6 and 7 for generating the first high voltage level $U_1$ at the connection 161 which is substantially constant.

The second low voltage source 107 comprises a second high frequency inverter 111, a second resonance circuit 112 which is connected with the second frequency inverter 111 and a second high voltage transformer 113, which is connected with its primary side with the second resonance circuit 112 and which supplies the input of a high voltage generator 115 with an AC-voltage at its secondary side, which AC-voltage is isolated by means of the second transformer 113 (wherein other topologies can be used as well to provide an isolated AC voltage for the high voltage generator 115). At the output of the high voltage generator 115, the second low voltage level $U_2$ is provided.

The first and the second voltage levels $U_1$, $U_2$ are again cascaded, so that the X-ray tube 17 is supplied via output terminals 15, 16 with a high output voltage which is the sum of the first and the second voltage levels, and wherein the high voltage generator 115 generates the second voltage level such, that it is approximately equal to the difference between the required high output voltage at the terminals 15, 16 of the power supply, and the first high voltage level at the connection 161 of the first high voltage source 106.

The high output voltage level is measured and compared with a reference voltage level $U_{ref}$ by means of a controller circuit 301. The controller circuit 301 is provided for controlling the second high frequency inverter 111 and the high voltage generator 115 (and optionally the first high frequency inverter 11 as well) to set the desired high output voltage level at the output terminals 15, 16 which are connected with the X-ray tube 17.

By the third to fifth embodiment, the high output voltage level at the output terminals 15, 16 can be switched within about 20 μs or less between—on the one hand—a lower value which is substantially equal to the first voltage level $U_1$ if the second voltage level $U_2$ is about zero, or which is substantially equal to the first voltage level $U_1$ minus the second voltage level $U_2$ if it has a minimum (negative) value, and—on the other hand—an upper limit value which is substantially equal to the sum of the first and the second voltage levels $U_1+U_2$ if the second voltage $U_2$ has its maximum positive value (or is zero). Additionally, by switching the second voltage level $U_2$ to at least one intermediate value between zero (or the minimum negative value) and the maximum value (or zero), not only dual-kV, but also multi-kV switching schemes can be realized. This is one substantial feature of this invention.

By extending the dual-kV switching method to a multi-kV switching method, clinical images with an improved contrast and image quality can be obtained which is advantageous especially for spectral CT methods. Furthermore, a quantification, also of a contrast medium, is enabled. By the increased contrast-to-noise-ratio the following advantages can be achieved:

an improved detectability in standard CT procedures, a reduced amount of the required contrast agent, a reduced X-ray dose while the detectability of conventional CT procedures is maintained, enabling new applications that require e.g. good soft tissue contrast.

Furthermore, by providing CT images with energy information by means of the power supply according to the invention, functional and molecular imaging with CT systems (e.g. use of fibrin targeted contrast agents with a large Gadolinium cluster that can be imaged with K-edge imaging) is enabled.

Apart from the above described power supply, another feature of the invention is related to a fast data-acquisition method using at least one X-ray detector, wherein the data acquisition is synchronously conducted with the switching of the high output voltage levels applied to the X-ray tube. Basically, the X-ray radiation having a certain spectrum according to a certain high output voltage level setting is acquired separately for each high output voltage level. This means that n subframe image data values for n different high output voltage level settings are obtained.

For processing the detected X-ray image data, an information about the actual high output voltage level at the X-ray tube (i.e. a X-ray radiation spectrum information) for each detected X-ray image data-set is needed. In order to gain such information, the related power supply can e.g. generate an analog voltage or digital values and a time stamp information which can be merged together with a time stamped X-ray detector value.

If counting readout-electronic devices are used, the information from the slope of the high output voltage level of the power supply can be used as well in order to correlate to each high output voltage level setting the related X-ray radiation spectrum by means of calibration and look-up-table methods.

The sequence of the high output voltage levels can vary according to a user-selected generation or switching scheme.

Figures 9A, 9B:
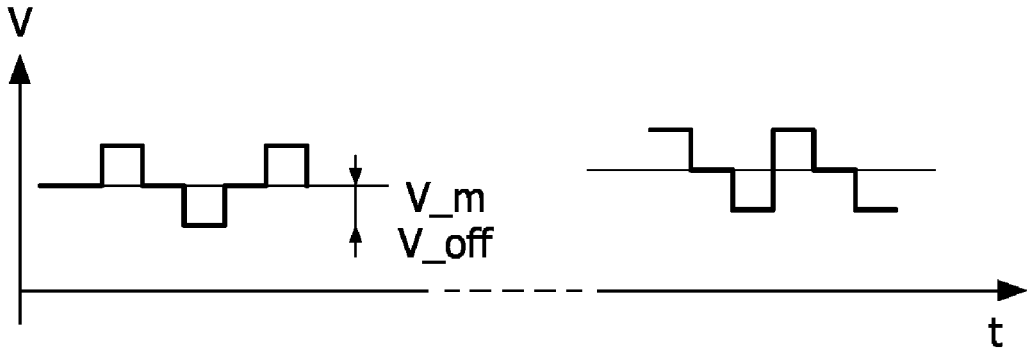
FIG. 9 shows a first and a second switching scheme for different high output voltage levels.

One such possible switching scheme is a symmetric and stepwise increase and decrease of the high output voltage level V ($=U_1+U_2$) with minimized settling times according to FIG. 9(A). In order to achieve a minimum settling time, the X-ray tube 17 (19) can additionally be switched off with grid switch technologies, e.g. the grid switch unit 18 (20) while the new high output voltage level is settled. This reduces the smearing effects between the different X-ray radiation spectra images.

Another possible switching scheme is a sequence of high output voltage levels V in the form of unsymmetric waves according to FIG. 9(B) or multi-waves (symmetric and unsymmetric) per frame-time.

In FIGS. 9 (A) and (B) V_m is an average or middle high output voltage level, e.g. the above first constant high voltage level $U_1$, and V_off is an offset voltage, e.g. the above controllable second lower voltage level $U_2$ which is switched between (at least one) positive and (at least one) negative level (normally V_off is the same for the positive and negative step height).

If desired, the first high voltage level can be tuned as well. The slope of both high output voltage levels should be minimized (below about 20 μs) so that ideally a rectangular form is achieved as indicated in FIGS. 9(A), 9(B). A possible ripple on the high output voltage of each high output voltage setting is not critical as the resulting deviation can be corrected for.

Figure 10:
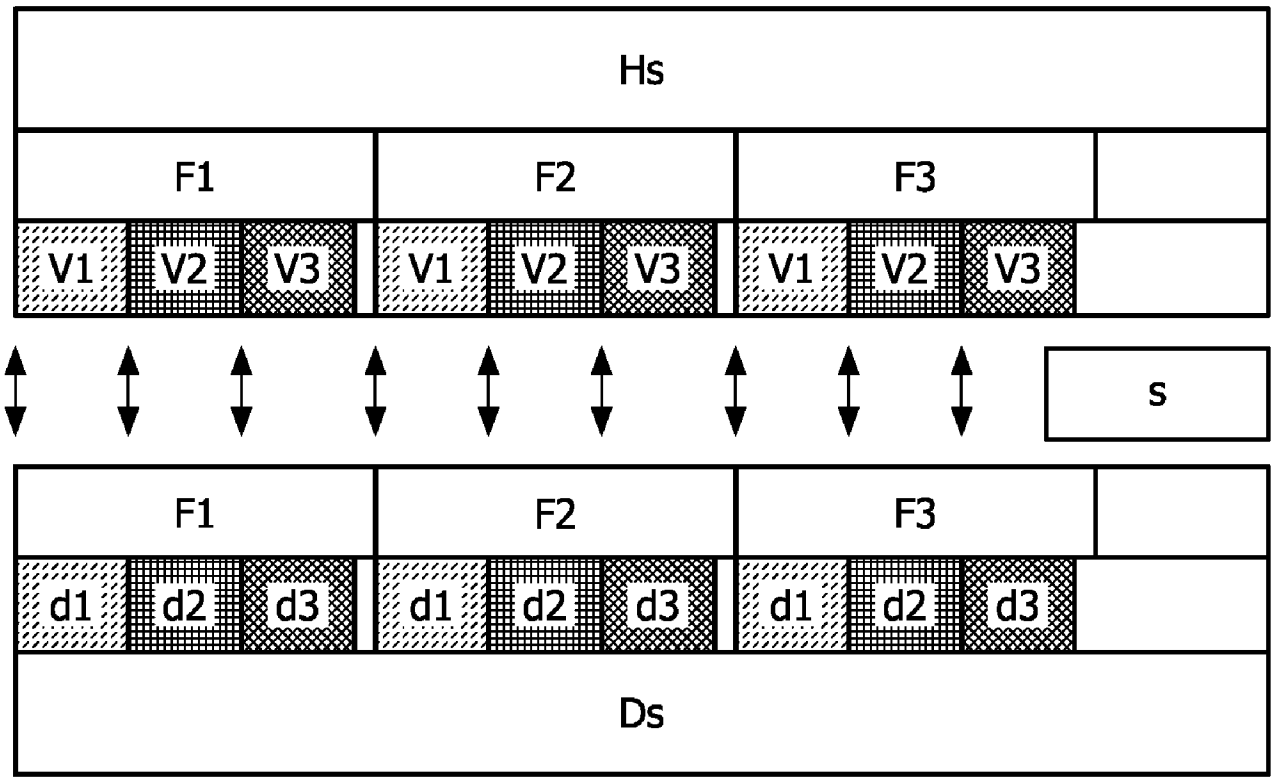
FIG. 10 shows an exemplary data acquisition scheme in relation to a high voltage switching scheme of an imaging device.

FIG. 10 schematically shows an exemplary data acquisition scheme Ds of an imaging device in a time-synchronized relation s to a high voltage switching scheme Hs. The data acquisition system Ds has to be synchronized with the switching scheme Hs of the high voltage generator 101 and/or the grid switch units 18, 20 of the X-ray segment in order to ensure the assignment of measured data d1, d2, d3 within each one frame F1, F2, F3 to a high voltage V1, V2, V3 of the X-ray tube 17, 19. This can be realized with the synchronization links between the controller circuit 301 and the grid switch units 18, 20 as indicated e.g. in FIG. 5. By means of these links a trigger of the grid-switch units 18, 20 can be synchronized with the controller 301 that also ensures the synchronization with the data acquisition unit.

The switching scheme according to FIG. 10 allows the correlation of the X-ray tube voltage V1 from the high voltage generator 101 with the measured data d1 in frame F1 and the following voltages Vx (V2, V3) with the data dx (d2, d3) in the same frame. The data-blocks d1, d2, d3, . . . are the sub-frame measurements within one imaging frame (e.g. frame F1). These sub-frame data can be used for the calculation of the energy information due to the different X-ray spectra of the X-ray tube 17, 19 with the correlated voltages within the defined image-frame.

The sub-frame information can also be used for additional image improving corrections due to the high temporal resolution of these measurements.

In FIG. 5 the grid switches are preferably controlled via the grid switch units 18, 20 independently from each other by means of the controller circuit 301.

The inventive approach has the advantage that it allows an energy detection without major modifications of the complete detector concept so that substantially standard components can be used. Furthermore, the dual X-ray tube concept can be realized with the inventive methods as well.

According to the invention, use is especially made of a conventional X-ray source operated at least two different very fast switchable high output voltage levels providing with different but well known polychromatic emission spectra within one conventional image frame. The image data are acquired with a conventional CT detector with n sub-frames replacing the conventional frame. The sub-frame timing and the voltage switching of the X-ray tube is synchronized. The processing of the obtained data according to the spectral CT models allows generating different clinical images with enhanced contrast properties. In addition the method allows to directly measure a contrast medium with a K-edge leading to quantification and a contrast agent only image with all its new clinical features like identification of calcified plaque within a vessel.

Another considerable advantage is that the power supply according to the invention together with a conventional X-ray source can be used in certain application fields instead of expensive monochromatic synchrotron sources. One such application field is K-edge imaging, especially K-edge digital subtraction angiography in which commonly monochromatic X-rays from synchrotron sources are used (see Rubenstein E., Hofstadter Zeman H D, Thompson A C, et al. in "Transvenous coronary angiography in humans using synchrotron radiation", Proc. Natl. Acad. Sci. USA 1986; 83:9724-9728).

In such an application, after intravenous injection of a contrast agent, two images are produced with monochromatic X-ray beams above and below the contrast agent K-edge (iodine or gadolinium). The logarithmic subtraction of the two measurements results in an iodine- or gadolinium-enhanced image which can be precisely quantified. This technique is analyzed in Esteve et al., "Coronary angiography with synchrotron X-ray sources on pigs after iodine or gadolinium intravenous injection" (Acad. Radiology 2002, Vol. 9, Suppl. 1, 92-97) and discussed there as a less invasive technique than the conventional imaging procedure to follow patients after coronary interventions.

By this, a means for non-invasively rendering coronary arteries including precise quantitative information e.g. on a vessel lumen sizes can be provided, which means can be applied on standard X-ray computed tomography scanners, and is especially suitable for using contrast media (iodine or gadolinium) and is much less expensive than synchrotron X-ray sources.

Furthermore, it becomes possible for example to compute the axial dimension of the coronary arteries and the amount of iodine they contain so that a stenosis can be detected and quantified. The main interest of such a technique is its suitability to the follow up of the stenosis observed after a first usual coronary angiography based on Selective Arterial Angiography.

Finally, a short overview shall be given on why and how many different X-ray tube spectra and thus high output voltage levels are necessary in the X-ray source related spectral CT imaging concept according to the invention.

A special feature of spectral CT is the possibility to reconstruct contrast agent only images. To do this, at least three different polychromatic tube spectra are required. The reason for this is that the scanned object can be modeled by a linear combination of the photoelectric effect, Compton effect and contrast medium (CM) with K-edge as discussed in the following:

The decomposition of the linear attenuation coefficient $\mu(E, \vec{x})$ into an energy-dependent (and location-independent) part and an energy-independent (and location-dependent) part can be done by taking into account the two physical processes relevant in the CT energy region, namely Photoeffect and Compton scattering with their universal energy dependency $E^{-3}$ and $f_{KN}(E)$, respectively:

$$\mu(E, \vec{x}) = \underbrace{a(\vec{x})E^{-3}}_{Photoeffect} + \underbrace{b(\vec{x})f_{KN}(E)}_{Comptoneffect}$$

where $f_{KN}(E)$ is the Klein-Nichina formula. However, for coronary artery imaging with a contrast medium (CM), it may be helpful to introduce a further decomposition:

$$\mu(E, \vec{x}) = a(\vec{x})E^{-3} + b(\vec{x})f_{KN}(E) + \mu^*_{CM}(E)\rho_{CM}(\vec{x})$$

Where $\mu^*(E)$ ($cm^2/g$) is the mass attenuation coefficient and $\int\rho(\vec{x})d\vec{x}$ ($g/cm^2$) the area density:

$$\mu(E, \vec{x}) = \mu^*(E)\rho(\vec{x})$$

The Photoeffect and Compton terms should not already cover parts of the contrast medium term to allow for an easy contrast medium only image reconstruction.

For dealing with coronary calcifications, a fourth summand may be necessary and sufficient, which accounts for the calcification part of the image. It may allow for quantifying plaque thickness, i.e. the linear attenuation coefficient would be decomposed according to $$\mu(E, \vec{x}) = a(\vec{x})E^{-3} + b(\vec{x})f_{KN}(E) + \mu^*_{CM}(E)\rho_{CM}(\vec{x}) + \mu^*_{Ca}(E)\rho_{Ca}(\vec{x})$$

In general, in Computed tomography, the object to be scanned is assumed to be composed of a material mixture of m compounds represented by $\mu(E, \vec{x})$, so that the measured quantity M can be expressed by $$-\ln\left(\frac{\int E\Phi(E)e^{-\int\mu(E,\vec{x})d\vec{x}}dE}{\int E\Phi(E)dE}\right) =: M,$$

where $$\mu(E,\vec{x}) = \sum_{j=1}^{m} \mu_j^*(E)\rho_j(\vec{x})$$

represents the m compounds.

By taking more than one measurement with different tube spectra $\Phi_i(E)$, $i\in[1, \ldots, n]$ preferably with n different mean energies, one gets n non-linear equations with m unknowns $\int\rho_j(\vec{x})d\vec{x}$:

$$-\ln\left(\frac{\int E\Phi_i(E)e^{\sum_{j=1}^{m}-\mu_j^*(E)\int\rho_j(\vec{x})d\vec{x}}dE}{\int E\Phi_i(E)dE}\right) =: M_i$$

If the non-linear equations are solved for these unknowns (in case $n\geqq m$), the CT reconstruction can then determine $\rho_j(\vec{x})$ from real line integrals. It is important to note that the reconstructed quantity is the mass density, i.e. a quantity directly related to the concentration of the material in the scanned body. So, in this approach also quantitative information about the vessel lumen can be obtained, if the mass density of the contrast medium as a function of the location can be obtained accurately—the vessel lumen would be filled with contrast medium. Such quantitative information is an essential aspect in coronary angiography.

Since in particular, the object to be scanned is assumed to be composed of tissue, bone and maybe contrast medium, three measurements at three different tube voltages are sufficient. The approach works under the (correct) assumption that different soft-tissue (t) materials have a similar mass attenuation $\mu^*_t(E)$ and density $\rho_t(\vec{x})$, while that of bone (calcification) and contrast medium (iodine or gadolinium) differs among bone, iodine and gadolinium, and is also sufficiently different from that of soft tissue.

For K-edge imaging of a contrast medium it is preferred to use at least three different tube voltages providing spectra with mean energy below and above the K-edge, as well as a spectrum with mean energy very near to the K-edge of the contrast medium under investigation.

Another aspect is of technical nature. The set of non-linear equations has to be solved numerically, preferably with a maximum likelihood approach. The solution is known to be more sensitive and robust if the system is over determined, which means that even to reconstruct the densities of three different materials only, more than three different tube spectra and thus measurements are preferred from that point of view. It is important to note, that the proposed method does not rely on a subtraction of reconstructed images to obtain the final contrast enhanced image—as it is the case in conventional K-edge digital subtraction angiography with monochromatic x-rays (from a bulky synchrotron). This feature is very beneficial with regard to noise in the images, which are reconstructed from the complete set of measured data.

The invention claimed is:

1. A power supply for generating high output voltage for supplying an X-ray generator system with at least one X-ray source, the power supply comprising:

at least a first voltage source for providing voltage at a first voltage source level and a second voltage source for providing voltage at a second voltage source level; the first and second voltage sources are connected in a cascade to generate the high output voltage;

the high output voltage comprises at least a first high output voltage level substantially equal to the first voltage source level and a second high output voltage level substantially equal to the cascaded first and second voltage source levels; and a switchable output terminal having a switch for switching between the first high output voltage level and the second high output voltage level during an X-ray scanning operation.

2. The power supply according to claim 1, wherein the second voltage source level is lower than the first voltage source level.

3. The power supply according to claim 1, comprising a high voltage multiplier having a plurality of stages numbered from $a^{th}$ to $z^{th}$ stage, wherein the first voltage source level is branched off between a stage b and a stage f and the second voltage source level is branched off between a stage k and a stage m, and wherein $b<f\leqq k<m\leqq z$.

4. The power supply according to claim 1, wherein the second voltage source is provided for switching between a first voltage source level of approximately zero and at least one predetermined positive or negative second voltage source level.

5. The power supply according to claim 1, comprising a controller circuit for detecting an actual high output voltage level and for supplying at least one of a first and a second control signal for controlling at least one of the first and the second voltage source, respectively, such that a selected high output voltage level is generated.

6. The power supply according to claim 5, wherein the controller circuit is provided for supplying at least a third control signal for controlling at least one grid switch or grid switch unit of at least one X-ray tube for controlling the same.

7. The power supply according to claim 1, wherein the first voltage source comprises a first high frequency inverter, a first resonance circuit, and a first high voltage transformer for operating a high voltage multiplier.

8. The power supply according to claim 7, wherein the second voltage source comprises a controllable second high frequency inverter and a second resonance circuit for supplying a second high voltage transformer for generating the second voltage level in the form of an AC voltage level.

9. The power supply according to claim 7, wherein the second voltage source comprises a high voltage rectifier for rectifying the second high voltage AC level and for generating the second voltage source level in the form of a DC voltage level.

10. The power supply according to claim 7, wherein the second voltage source comprises a second high frequency inverter, a second resonance circuit and a second high voltage transformer for supplying a high voltage generator for generating the second voltage source level.

11. The power supply according to claim 1, wherein the power supply is utilized in an X-ray tube generator system comprising at least one X-ray tube.

12. The power supply according to claim 11, wherein the X-ray tube generator system is part of a computer tomography (CT) apparatus.

* * * * *